US009919230B2

(12) United States Patent
Li et al.

(10) Patent No.: US 9,919,230 B2
(45) Date of Patent: Mar. 20, 2018

(54) FRICTIONAL JOINT FOR A TOY FIGURE

(71) Applicant: Mattel, Inc., El Segundo, CA (US)

(72) Inventors: Josiah To Sang Li, Monterey Park, CA (US); Jian Sheng Hu, Guangzhou (CN); Wai Nang Lam, Kowloon (HK); Sun Ho Chan, New Territories (HK)

(73) Assignee: Mattel, Inc., El Segundo, CA (US)

( * ) Notice: Subject to any disclaimer, the term of this patent is extended or adjusted under 35 U.S.C. 154(b) by 976 days.

(21) Appl. No.: 13/705,994

(22) Filed: Dec. 5, 2012

(65) Prior Publication Data

US 2013/0165016 A1 Jun. 27, 2013

Related U.S. Application Data

(60) Provisional application No. 61/567,607, filed on Dec. 6, 2011.

(51) Int. Cl.
*A63H 3/46* (2006.01)
*A63H 9/00* (2006.01)

(52) U.S. Cl.
CPC ..... *A63H 3/46* (2013.01); *A63H 9/00* (2013.01); *Y10T 29/4984* (2015.01)

(58) Field of Classification Search
CPC ..... A63H 3/46; A63H 9/00; Y10T 29/4984
USPC ..... 446/376, 378
See application file for complete search history.

(56) References Cited

U.S. PATENT DOCUMENTS 246,867 A * 9/1881 Cooke ..... 446/376
1,176,209 A * 3/1916 Dice ..... 446/376
1,579,367 A 4/1926 Hymer
1,939,677 A 12/1933 Epstein
2,552,216 A * 5/1951 Rekettye ..... 446/376
(Continued)

FOREIGN PATENT DOCUMENTS

CH 646612 A5 12/1984
CN 1237467 12/1999
(Continued)

OTHER PUBLICATIONS

State Intellectual Property Office of the P.R.C., Office Action for Chinese Patent Application No. 201210595694.9, dated Aug. 29, 2014, 20 pages.
(Continued)

*Primary Examiner* — Melba Bumgarner
*Assistant Examiner* — Joseph B Baldori
(74) *Attorney, Agent, or Firm* — Kolisch Hartwell, P.C.

(57) ABSTRACT

Hip joint assemblies, and posable toy figures that incorporate the hip joint assemblies, including a pelvis housing having a front portion and a back portion, where the front and back portions in combination define side openings in the pelvis housing, and a contoured friction plate vertically disposed within the pelvis housing. The hip joint assembly further includes two leg sections, each leg section having a disk member attached via a hip post, and each leg combined with the pelvis housing so that the disk member lies within the pelvis housing and the hip post passes through a side opening so that the face of the disk member abuts a face of the contoured friction plate, and the frictional interaction between the disk face and the friction plate renders the attached leg posable as it pivots around the axis defined by its hip post.

12 Claims, 3 Drawing Sheets

(56) References Cited

U.S. PATENT DOCUMENTS

| | | | | | |
|---|---|---|---|---|---|
| 2,653,415 | A | * | 9/1953 | Becker | 446/376 |
| 2,884,739 | A | * | 5/1959 | Ketcham | 446/376 |
| 2,925,684 | A | * | 2/1960 | Weissbrodt et al. | 446/379 |
| 3,009,284 | A | * | 11/1961 | Ryan | 446/376 |
| 3,099,895 | A | * | 8/1963 | Beebe | 446/376 |
| 3,168,227 | A | * | 2/1965 | Osmond | 223/66 |
| 3,254,442 | A | * | 6/1966 | Ostrander | 446/376 |
| 3,300,892 | A | * | 1/1967 | Gardel et al. | 446/378 |
| 3,604,147 | A | * | 9/1971 | Ceccon | 446/355 |
| 3,699,715 | A | * | 10/1972 | Lewis et al. | 446/376 |
| 3,731,426 | A | | 5/1973 | Lewis et al. | |
| 3,874,112 | A | | 4/1975 | Sapkus et al. | |
| 3,900,992 | A | | 8/1975 | Klamer | |
| 3,992,807 | A | | 11/1976 | Sapkus et al. | |
| 3,994,092 | A | * | 11/1976 | Sapkus et al. | 446/333 |
| 3,995,394 | A | | 12/1976 | Ayton | |
| 3,995,395 | A | * | 12/1976 | Rahmstorf | 446/100 |
| 4,003,158 | A | | 1/1977 | Wolf et al. | |
| 4,006,555 | A | | 2/1977 | England et al. | |
| 4,069,613 | A | | 1/1978 | Lemelson et al. | |
| 4,310,927 | A | | 1/1982 | Debose | |
| 4,536,165 | A | * | 8/1985 | Maar | 446/153 |
| 4,571,209 | A | * | 2/1986 | Manning et al. | 446/375 |
| 4,595,379 | A | | 6/1986 | Rasmussen et al. | |
| 4,608,026 | A | * | 8/1986 | Newton et al. | 446/330 |
| 4,623,318 | A | | 11/1986 | Tsiknopoulos et al. | |
| 4,673,367 | A | | 6/1987 | MacBain | |
| 4,680,019 | A | | 7/1987 | Baerenwald et al. | |
| 4,723,932 | A | | 2/1988 | Kelley et al. | |
| 4,854,911 | A | | 8/1989 | Berliner et al. | |
| 4,968,280 | A | | 11/1990 | Kelley | |
| 4,968,282 | A | * | 11/1990 | Robson et al. | 446/376 |
| 4,988,323 | A | | 1/1991 | Price | |
| 4,995,846 | A | * | 2/1991 | Mariol | 446/376 |
| 5,052,971 | A | * | 10/1991 | Young | 446/376 |
| 5,079,778 | A | | 1/1992 | Sloot | |
| 5,394,766 | A | | 3/1995 | Johnson et al. | |
| 5,419,729 | A | | 5/1995 | Gross | |
| 5,516,322 | A | | 5/1996 | Myers | |
| 5,580,295 | A | * | 12/1996 | Ruzskai et al. | 446/378 |
| 5,664,983 | A | | 9/1997 | Hollis | |
| 6,022,263 | A | | 2/2000 | Liu et al. | |
| 6,171,169 | B1 | | 1/2001 | Saunders | |
| 6,224,456 | B1 | | 5/2001 | Wittenberg | |
| 6,267,640 | B1 | | 7/2001 | Akashi et al. | |
| 6,273,781 | B1 | | 7/2001 | Yamasaki | |
| 6,419,546 | B1 | * | 7/2002 | Akashi et al. | 446/376 |
| 6,422,916 | B1 | * | 7/2002 | Enku | 446/330 |
| 6,439,952 | B1 | | 8/2002 | Yamamura | |
| 6,478,653 | B1 | | 11/2002 | Langton | |
| 6,482,068 | B2 | | 11/2002 | Lee et al. | |
| 6,494,763 | B1 | * | 12/2002 | Hastey | 446/376 |
| 6,514,119 | B1 | | 2/2003 | Lee et al. | |
| 6,568,984 | B1 | | 5/2003 | Applewhite | |
| 6,638,136 | B1 | | 10/2003 | Lee et al. | |
| 6,805,606 | B1 | | 10/2004 | Kellum | |
| 6,817,921 | B2 | * | 11/2004 | Chin et al. | 446/376 |
| 6,830,497 | B1 | | 12/2004 | Lee et al. | |
| 6,869,331 | B2 | | 3/2005 | Lee et al. | |
| 6,932,669 | B2 | * | 8/2005 | Lee et al. | 446/375 |
| 7,021,989 | B2 | | 4/2006 | Wai | |
| 7,077,717 | B2 | | 7/2006 | Cheng et al. | |
| 7,566,256 | B2 | | 7/2009 | Wai | |
| 7,588,478 | B2 | | 9/2009 | Lashinsky | |
| 7,654,881 | B2 | | 2/2010 | Nakazato et al. | |
| 2003/0027488 | A1 | | 2/2003 | Langton | |
| 2003/0162477 | A1 | | 8/2003 | Jheow | |
| 2004/0082265 | A1 | * | 4/2004 | Langton | 446/373 |
| 2005/0112993 | A1 | | 5/2005 | Cheng et al. | |
| 2007/0149089 | A1 | | 6/2007 | De La Torre | |
| 2008/0194176 | A1 | | 8/2008 | Pennington | |
| 2008/0261484 | A1 | | 10/2008 | Culpepper | |
| 2010/0167624 | A1 | | 7/2010 | Asai | |
| 2011/0097969 | A1 | | 4/2011 | Defelice et al. | |
| 2011/0189922 | A1 | | 8/2011 | Handy et al. | |

FOREIGN PATENT DOCUMENTS

| | | | |
|---|---|---|---|
| CN | 1711120 | | 12/2005 |
| CN | 201997102 | | 10/2011 |
| EP | 0582020 | A1 | 2/1994 |
| FR | 2657536 | A1 | 8/1991 |
| GB | 2342758 | A | 4/2000 |
| GB | 2346815 | A | 8/2000 |
| JP | 62128719 | A | 6/1987 |
| JP | 04288187 | A | 10/1992 |
| JP | 06023154 | A | 2/1994 |
| JP | 06277367 | A | 10/1994 |
| JP | 2004305275 | A | 11/2004 |
| JP | 2005344936 | A | 12/2005 |

OTHER PUBLICATIONS

Hasbro, Photos of ActionMan Power Arm Ninja 27553, 1996, 2 pages.

State Intellectual Property Office of the P.R.C., Office Action for Chinese Patent Application No. 201210595694.9, dated Jan. 18, 2016, 18 pages.

* cited by examiner

FRICTIONAL JOINT FOR A TOY FIGURE

CROSS-REFERENCE TO RELATED APPLICATIONS

This applications claims the benefit under 35 U.S.C. § 119(e) of provisional patent application Ser. No. 61/567,607 for FRICTIONAL JOINT FOR A TOY FIGURE, filed Dec. 6, 2011 and hereby incorporated by reference.

FIELD OF THE DISCLOSURE

This disclosure relates to frictional joints for toy figures. More particularly, the disclosure relates to systems and methods for permitting a leg of a toy figure to pivot at a hip, with minimal parts, simplified assembly, and particularly robust performance.

BACKGROUND OF THE DISCLOSURE

Children enjoy a variety of toy figures, such as action figures and dolls, which can be manipulated to simulate real life activities, and assume natural poses and positions. Hopefully, these toy figures stimulate the imaginations of children by providing a variety of play options.

One way of increasing available play options is to provide toy figure toys with numerous movable joints, constructed from durable, strong, moldable plastic. Preferably, the toy figures are posable, and include joints that will stay in a given position once they have been manipulated. Such toy figures may often incorporate frictional joints to render the figures more posable.

Examples of posable action figures having movable parts and joints may be found in U.S. Patent Publications U.S. Pat. No. 1,579,367, U.S. Pat. No. 1,939,677, U.S. Pat. No. 3,731,426, U.S. Pat. No. 3,874,112, U.S. Pat. No. 3,992,807, U.S. Pat. No. 3,995,394, U.S. Pat. No. 4,310,927, U.S. Pat. No. 4,988,323, U.S. Pat. No. 5,079,778, U.S. Pat. No. 5,394,766, U.S. Pat. No. 5,419,729, U.S. Pat. No. 5,516,322, U.S. Pat. No. 5,664,983, U.S. Pat. No. 6,022,263, U.S. Pat. No. 6,267,640, U.S. Pat. No. 6,439,952, U.S. Pat. No. 6,478,653, U.S. Pat. No. 6,514,119, U.S. Pat. No. 6,568,984, U.S. Pat. No. 6,638,136, U.S. Pat. No. 6,805,606, U.S. Pat. No. 6,830,497, U.S. Pat. No. 6,869,331, U.S. Pat. No. 7,566,256, US20030027488, US20030162477, US20050112993, US20070149089, US20080194176, and US20080261484; and foreign patent publications CH646612, EP582020, FR2657536, GB2342758, GB2346815, JP04288187, JP06023154, JP06277367, JP2004305275, JP2005344936, and JP62128719. The complete disclosures of the above patents and patent applications are herein incorporated by reference for all purposes.

SUMMARY OF THE DISCLOSURE

The present disclosure relates generally to a posable hip joint for toy figures, and posable toy figures incorporating the posable hip joint. More specifically, the present disclosure relates to hip joint assemblies that include a pelvis housing having a front portion and a back portion, where the front and back portions in combination define side openings in the pelvis housing, and a contoured friction plate vertically disposed within the pelvis housing. The hip joint assembly further includes two leg sections, each leg section having a disk member attached via a hip post, and each leg combined with the pelvis housing so that the disk member lies within the pelvis housing and the hip post passes through a side opening so that the face of the disk member abuts a face of the contoured friction plate, and the frictional interaction between the disk face and the friction plate renders the attached leg posable as it pivots around the axis defined by its hip post.

The advantages conferred by the disclosed hip joint assembly will be more readily understood after considering the drawings and the Detailed Description.

DETAILED DESCRIPTION OF THE DISCLOSURE

Figure 1:
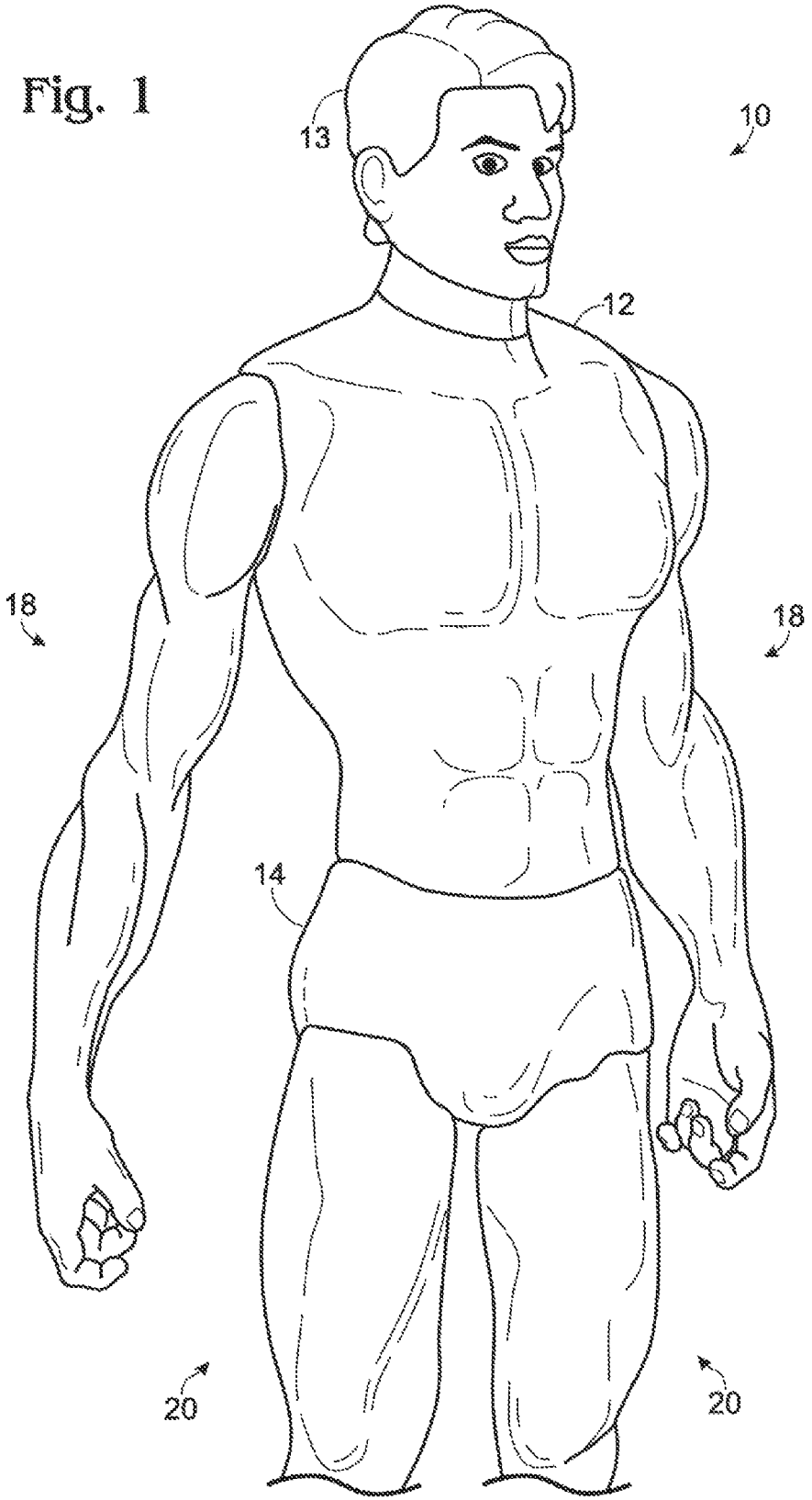
FIG. 1 is a partial three-quarter view of a toy figure according to one embodiment of the present invention.

Referring to FIG. 1, a toy figure such as an action FIG. 10 or doll 10 is shown. Such toy figures may include an upper torso 12, a head 13 coupled to upper torso 12, a lower torso or pelvis 14 coupled to upper torso 12, arms 18 coupled to upper torso 12, and legs 20 coupled to upper torso 12. Pelvis 14 may be coupled to upper torso 12 via some type of rotational and/or flexible waist joint.

Head 13 and arms 18 may be coupled to upper torso 12 via a joint having a some degree of articulation. For example, the head and arms may be coupled to upper torso 12 via a rotational joint, or via a more flexible articulation such as a ball-and-socket joint, or other type of articulated coupling. Similarly, pelvis 14 may be coupled to upper torso 12 via an articulated joint having a greater or lesser degree of freedom of movement.

Figure 2:
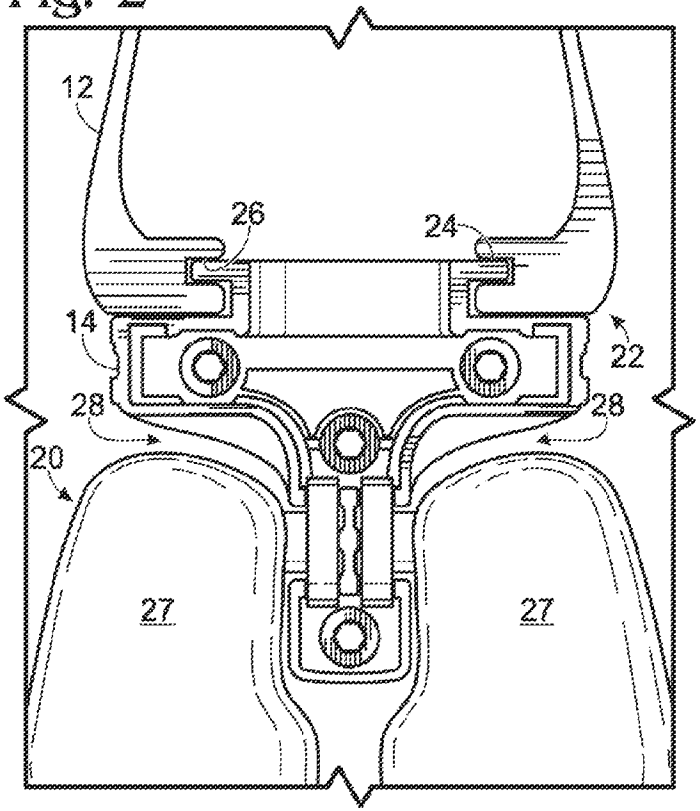
FIG. 2 depicts a cutaway front view of a pelvis portion of the toy figure of FIG. 1, showing selected internal elements and joints of the toy figure, in combination with a cutaway front view of the lower torso of the toy figure and a front view of the upper legs of the toy figure.

For example, and as shown in FIG. 2, pelvis 14 may be coupled to upper torso 12 via a rotational waist joint 22 that may include a flange 24 of pelvis 14 that may cooperatively interlock with an internal slot 26 of upper torso 12. Pelvis 14 may be additionally coupled to one or more legs 20, for example via thigh portions 27 of the legs 20, where the coupling between the thigh portion and the pelvis forms one or more hip joints 28.

Figure 3:
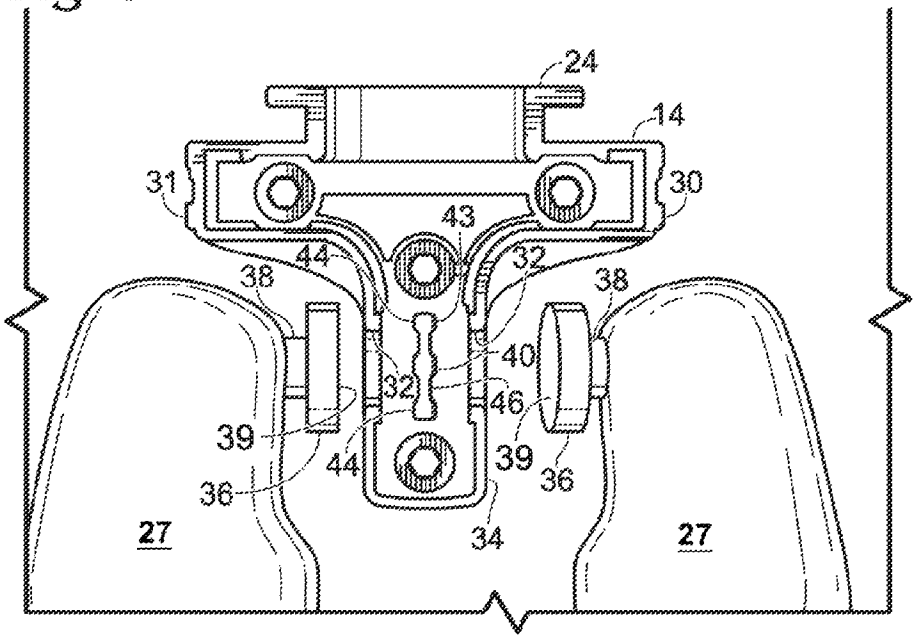
FIG. 3 is a front exploded cutaway view of the pelvis portion and upper legs of FIG. 2, with one leg slightly rotated outward.

Pelvis 14 is shown in FIG. 2 in a cutaway view that reveals selected internal elements of the hip joint 28 that couples thigh portions 27 to pelvis 14. FIG. 3 depicts a cutaway view of pelvis 14 and thigh portions 27 in a slightly exploded view to more clearly depict the elements that make up hip joints 28. As disclosed, hip joints 28 include an exemplary frictional joint construction. Additional or alternative joints, for example joints that couple head 13 to upper torso 12, or that couple arms 18 to upper torso 12, are by way of background, and are not necessary or essential to the frictional joint construction of the present invention. Some embodiments, by way of example and not shown, may include the disclosed frictional joint construction within a torso that includes a pelvis portion, that is, lacking a waist joint. In such embodiments, legs 20 may be coupled to the unitary torso via the disclosed frictional joint construction, for example via the thigh portions 27 of the legs.

Lower torso or pelvis 14 typically includes a pelvis housing 30 that includes and is defined by a front pelvis portion 31*f* and a back pelvis portion 31*b*. In the cutaway views of FIGS. 2 and 3, the front portion of the pelvis housing is omitted for clarity. The front and back portions of the pelvis housing, when considered in combination, form pelvis 14 of toy FIG. 10. Leg sections 20 of the toy figure are coupled to pelvis 14 via two opposed openings 32 in the pelvis. The openings 32 are typically defined by the front and back portions of the pelvis housing, considered in combination, and are typically disposed on either side of at least a portion of the pelvis. That is, the openings 32 may be disposed on opposite sides of the pelvis housing, for example at the extreme right and extreme left sides of the pelvis. More typically, pelvis 14 incorporates a narrower and/or downwardly extending portion 34, and openings 32 are disposed on either side of portion 34 of the pelvis. In one embodiment of the invention, openings 32 are disposed on a right side and a left side of narrower and/or downwardly extending portion 34, as shown in FIG. 3. In such embodiments, openings 32 may be symmetrically disposed on either side of portion 34 of pelvis 14. Alternatively or in addition, the two opposed openings 32 may be approximately circular so as to facilitate free rotation of the leg sections 27 with respect to torso 14, that is, in order to facilitate rotational movement around the hip joint.

Each hip joint 28 may include a disk member 36 coupled to leg 20. Typically, the disk member 36 is attached to the thigh portion 27 of leg 20 via a post 38. Post 38 is sized so as to be disposed within one or the other of the side openings 32 with sufficient freedom of motion to permit rotation of the post within the opening. Disk member 36 is typically larger in diameter than post 38, and is generally sufficiently large that disk member 36 is retained within the pelvis housing by virtue of being unable to pass through opening 32. In some embodiments, the hip post 38 may exhibit a post diameter that is about half the diameter of the disk member to which it is coupled. Each disk member 36 typically presents a substantially flat disk face 39 facing outwardly from leg 20. Typically disk face 39 is the outward disk face, and is opposed to the inner face of disk member 36, which serves as an attachment point for post 38.

Within the pelvis housing 30, disposed so as to frictionally interact with one or both of disk members 36, is a friction plate 40. Friction plate 40 may be substantially planar, and may define an outline that is approximately rectangular, approximately square, approximately circular, or having any other peripheral outline that does not substantially interfere with the function of the hip joint for which it serves as a component, or any other functionality of the toy figure. Typically, friction plate 40 is at least substantially defined by opposing faces 42. The faces 42 of friction plate 40 are typically configured to abut disk face 39 of each leg member. That is, once the hip joint is assembled, each outwardly oriented face 39 of a disk member 36 makes substantial frictional contact with a side or face 42 of a friction plate 40.

Figure 4:
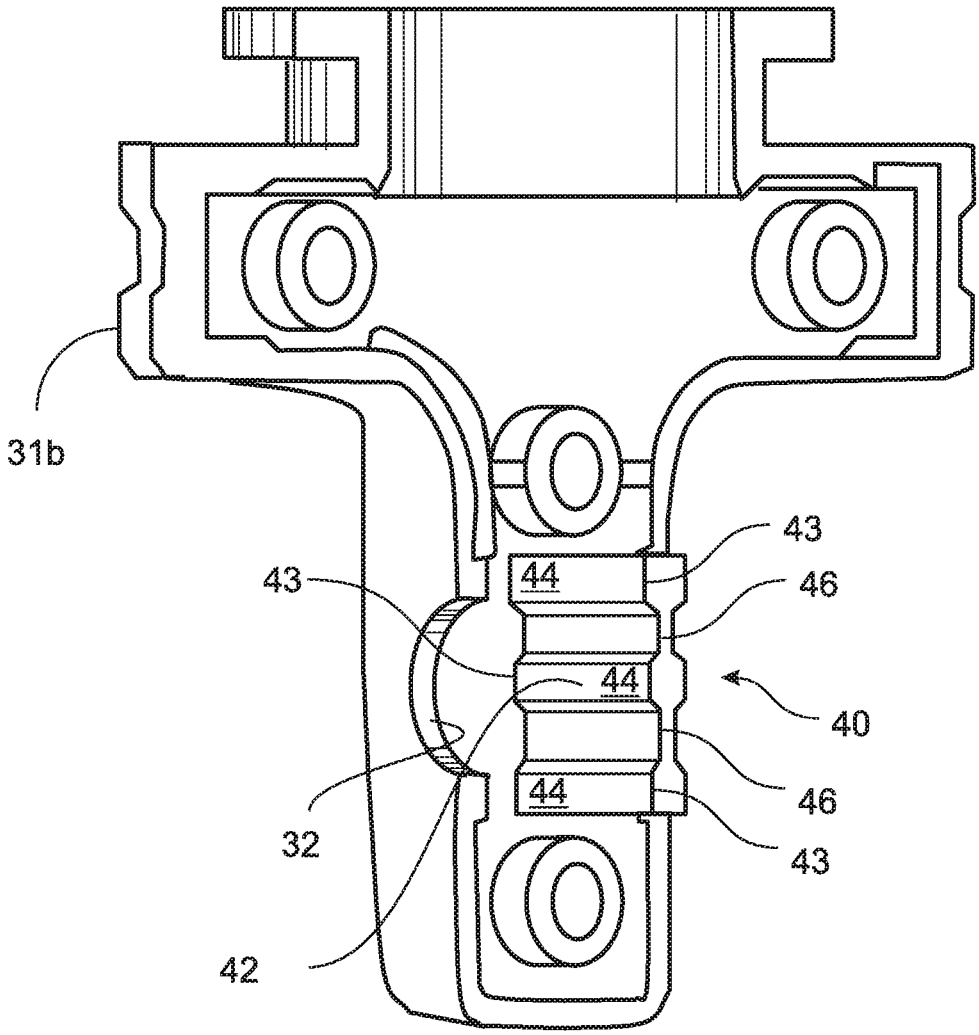
FIG. 4 shows a cutaway three-quarter view of the pelvis portion of the toy figure of FIG. 1, including a friction plate.

The plane defined by friction plate 40 is typically symmetrically disposed, for example along the right/left mirror plane of the pelvis housing. Friction plate 40 is therefore typically also aligned with the centerline of toy FIG. 10, by virtue of the overall symmetry typically exhibited by the torso of a toy figure. Friction plate 40 typically is integrally formed as a portion of pelvis housing 30. For example, as shown in FIG. 4, friction plate 40 may be integral with, and connected to, back portion 31*b* of pelvis housing 30. Friction plate 40 may be formed as a portion of pelvis housing 30 via an injection molding process. The integral formation of the friction plate simplifies the manufacture and assembly of toy figures incorporating the friction plate in the hip joints of the figures.

During assembly of toy FIG. 10, legs 20 may be attached to pelvis 14 by disposing disk members 36 within pelvis housing 30 so that hip posts 38 are within the side openings 32 of the pelvis housing 30. In so doing, the flat face 39 of each disk members is placed in contact with a side or face 42 of friction plate 40.

One or both of disk face 39 and face 42 of friction plate 40 may incorporate one or more contour features, where a contour feature is any feature configured to enhance the frictional contact between disk member 36 and friction plate 40, and thereby achieve a desired degree of resistance to leg movement. In one embodiment, the disk face 39 is relatively smooth, while the friction plate 40 incorporates one or more contour features 43. In an alternative embodiment, the face of friction plate 40 is relatively smooth, while disk face 39 incorporates one or more contour features 43. Where both disk face 39 and plate face 42 incorporate contour features, the particular contour features disposed on each may be the same or different.

Any surface feature that enhances the frictional resistance between a disk member 36 and a friction plate 40 may be an acceptable contour feature for the purposes of the present disclosure. The contour features of the present invention typically incorporate raised and lowered areas, and such raised and lowered areas may define a regular or irregular pattern on the surface of that face. In one embodiment of the invention, the contoured surface features 43 include one or more horizontal and/or parallel ribs 44, alternating with depressed or inset regions 46. While the exact number of horizontal ribs in any such surface contour pattern may vary, in one embodiment the contoured surface features include one or more horizontal ribs 44 alternating with depressed or inset regions 46. In another embodiment of the invention, and as depicted in FIG. 4, friction plate 40 may incorporate contoured surface features 43 that include three horizontal and parallel ribs alternating with two depressed regions 46.

The effect of a given contoured surface pattern may be enhanced or decreased by selection of the spacing between the wall of the pelvis housing 30 and the faces 42 of contoured friction plate 40, as such spacing directly effects the interaction between disk member 36 and friction plate 40. That is, if the spacing between the wall of the pelvis housing 30 and the contoured friction plate is greater than the width of disk member 36, the leg section may be readily pivoted, but be incapable of remaining in a desired position. Similarly, where the spacing between the wall of the pelvis housing 30 and the contoured friction plate is overly narrow, the resulting pressure between the disk face 39 and the plate face 42 may result in a leg 20 that resists any attempts at movement, or that requires the application of considerable effort to overcome the frictional forces between the disk member 36 and the contoured friction plate 40 before the leg can be repositioned.

Typically, the spacing between the wall of pelvis housing 30 and friction plate 40 is selected so that disk member 36 fits snugly therebetween. An appropriate fit for disk member 36 is one for which the frictional contact between the disk member and the friction plate permits the leg 20 to be posably pivoted forward and backward around an axis defined by the hip post 38 for that leg. Preferably, the frictional contact between the disk face 39 and face 42 of friction plate 40 is sufficient to hold the leg member in a desired position until it is actively repositioned, while not so strong as to render the leg resist movement. In one embodiment, the frictional contact between the disk face 39 and friction plate 40 is such that the toy figure may be posed standing on one or both legs 20, or a similar life-like position. The ability to pose the toy figure adds play value to the figure, as it may be posed by a child at play and the figure will readily maintain the desired pose. For example, the toy figure may be posed in a walking position, while disposed on a table or other supporting surface.

It should be appreciated that various alternative descriptions of the elements and relationships discussed above and shown in the drawings are possible. For example, the contoured surface features of the contoured friction plate may incorporate a checkerboard pattern of raised and depressed sections, rather than alternating ribs and depressed areas. In another alternative embodiment, the interface between the disk member and the friction plate may exhibit a degree of curvature, rather than being substantially planar. Similarly, the hip post and or the side openings may be configured to permit additional rotational motion of the attached leg section, rather than simply a pivoting motion.

The various components of hip joint 28 and toy FIG. 10 may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. More particularly, the materials used to fabricate disk 36 and/or friction plate 40 may be selected so as to confer a desired coefficient of friction between the disk and friction plate. Typically, different types of plastic are selected for each of the disks and the friction plate. Suitable plastics may include high-density polyethylene (HDPE), low-density polyethylene (LDPE), polyvinyl chloride (PVC), polystyrene, acrylonitrile butadiene styrene (ABS), polycarbonate, polyethylene terephthalate (PET), polypropylene, nylon, or the like. Suitable foamed plastics may include expanded or extruded polystyrene, or the like.

In view of the above description, various combinations of elements may be described. For example, the disclosure includes a hip joint assembly 28 for a toy FIG. 10, including a pelvis housing 30 having a front portion 31*f* and a back portion 31*b*. Front portion 31*f* and back portion 31*b* in combination define at least two side openings 32 in the pelvis housing 30, and a contoured friction plate 40 vertically disposed within the pelvis housing 30.

Hip joint assembly 28 may include a first leg section 27 having a first disk member 36 coupled to the first leg section 27 via a first hip post 38, and configured so that the first disk member 36 is disposed within the pelvis housing 30 and the first hip post 38 passes through a side opening 32 in the pelvis housing 30, and the first disk member 36 having a first disk face 39.

Hip joint assembly 28 may include a second leg section 27 having a second disk member 36 coupled to the second leg section 27 via a second hip post 38, and configured so that the second disk member 36 is disposed within the pelvis housing 30 and the second hip post 38 passes through a side opening 32 in the pelvis housing 30, and the second disk member 36 having a second disk face 39.

The first disk face 39 and the second disk face 39 may each abut an opposing face of the contoured friction plate 40, such that frictional interaction between each disk face 39 and the corresponding contoured friction plate 40 face renders each leg section 27 posable as it is pivoted around an axis defined by the corresponding hip post 38. Contoured friction plate 40 may be vertically disposed along the centerline of pelvis housing 30. Each face of the contoured friction plate 40 may include a plurality of contour features 43. The plurality of contour features 43 may include a plurality of rib 44 structures. The rib 44 structures may be substantially parallel to one another. The rib 44 structures may be substantially horizontally oriented. The rib 44 structures may be separated by inset regions.

Contoured friction plate 40 may be sandwiched between the first disk member 36 and the second disk member 36. The face of each of the first disk member 36 and the second disk member 36 may be substantially flat.

Hip joint assembly 28 may further comprise an upper torso 12 section that is coupled to the pelvis 14 section. Upper torso 12 section may be pivotally coupled to the pelvis section 14 by a waist joint 22.

In hip joint assembly 28, each hip post 38 may have a post diameter that is about half the diameter of its associated disk member 36.

The disclosure includes a toy FIG. 10, comprising a pelvis member 14, coupled to the upper torso member 12 by an articulated waist joint 22; and two leg members 20 coupled to the pelvis member 14 by pivotable hip joint assemblies 28. Pelvis housing 30 may include a front portion 31*f* and a back portion 31*b* configured such that in combination the front portion 31*f* and the back portion 31*b* define two openings in the pelvis housing 30, and a contoured friction plate 40 that is vertically disposed within the pelvis housing 30. Each pivotable hip joint assembly 28 may include a disk member 36 coupled to one of the leg sections 27 via a hip post 38, where the disk member 36 is disposed within the pelvis housing 30 and the hip post 38 passes through one of the openings in the pelvis housing 30, and each disk member 36 has a disk face 39. Each disk face 39 may abut opposing faces of the contoured friction plate 40 such that a frictional interaction between each disk face 39 and the corresponding contoured friction plate 40 face renders each leg section 27 posable as it is pivoted on an axis defined by its hip post 38.

Toy FIG. 10 may further comprise an upper torso member 12; two arm members 18 coupled to the upper torso member 12 by articulated shoulder joints; and a head member 13 coupled to the upper torso member 12.

The disclosure includes method of manufacturing a hip joint assembly 28, comprising molding a front portion and a back portion of a pelvis housing 30; where the front and back portions are configured to be combined to form a pelvis housing 30 having at least two side openings 32, and at least one of the front portion and back portion incorporates a contoured friction plate 40 having two opposing faces. The method of manufacturing may comprise molding a first leg section 27 to include a disk member 36 coupled to the first leg section 27 via a first hip post 38, where the first hip post 38 is sized so as to fit within a side opening 32 in the pelvis housing 30, and the first disk member 36 includes a first disk face 39. The method of manufacturing may comprise molding a second leg section 27 to include a disk member 36 coupled to the second leg section 27 via a second hip post 38, where the second hip post 38 is sized so as to fit within a side opening 32 in the pelvis housing 30, and the second disk member 36 includes a second disk face 39. The method of manufacturing may comprise assembling the pelvis housing 30 by coupling the pelvis housing 30 front portion to the pelvis housing 30 back portion so that the first hip post 38 of the first leg section 27 is seated within a first side opening 32 in the pelvis housing 30, the second hip post 38 of the second leg section 27 is seated within a second side opening 32 in the pelvis housing 30, the first disk member 36 of the first leg section 27 abuts a first face of the contoured friction plate 40, and the second disk member 36 of the second leg section 27 abuts a second face of the contoured friction plate 40. The width of each disk member 36 and the space provided for that disk member 36 between the corresponding face of the contoured friction plate 40 and the wall of the pelvis housing 30 may be selected so that a frictional interaction between the disk face 39 and the contoured friction plate 40 face renders the coupled leg section 27 posable as it is pivoted around an axis defined by its hip post 38.

In the method of manufacturing, molding the front portion and back portion of the pelvis housing 30 and each leg section 27 may include injection molding. Molding the pelvis housing 30 portions and the leg sections 27 includes molding the disk members 36 and the contoured friction plate 40 from different plastic materials, where plastic materials are selected to confer a desired degree of frictional interaction between the disk member 36 and the contoured friction plate 40. Contoured friction plate 40 may be vertically oriented within the pelvis housing 30, and assembling the pelvis housing 30 includes sandwiching the contoured friction plate 40 between the disk members 36 of the leg sections 27. Molding the pelvis housing 30 portions and the leg sections 27 may include molding the contoured friction plate 40 to include a plurality of contour features 43, and molding the disk member 36 to have a substantially flat disk face 39. Molding the pelvis housing 30 portions may include molding the contoured friction plate 40 so that each friction plate face includes a plurality of rib 44 structures that are substantially parallel to one another, and that are separated by inset regions of the friction plate face.

Although the present invention has been shown and described with reference to the foregoing operational principles and preferred embodiments, it will be apparent to those skilled in the art that various changes in form and detail may be made without departing from the spirit and scope of the appended claims. The present invention is intended to embrace all such alternatives, modifications and variances.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the disclosure recites "a" or "a first" element or the equivalent thereof, such recitation should be understood to include incorporation of one or more such elements, neither requiring nor excluding two or more such elements.

Inventions embodied in various combinations and subcombinations of features, functions, elements, and/or properties may be claimed through a later related application, whether they are directed to a different invention or directed to the same invention, whether different, broader, narrower or equal in scope to the original invention, are also regarded as included within the subject matter of the inventions of the present disclosure.

What is claimed is:

1. A hip joint assembly for a toy figure, comprising:

a pelvis housing having a front portion and a back portion, where the front portion and the back portion in combination define at least two side openings in the pelvis housing, and a contoured friction plate vertically disposed within the pelvis housing;

a first leg section having a first disk member coupled to the first leg section via a first hip post, and configured so that the first disk member is disposed within the pelvis housing and the first hip post passes through a side opening in the pelvis housing, and the first disk member having a first disk face;

a second leg section having a second disk member coupled to the second leg section via a second hip post, and configured so that the second disk member is disposed within the pelvis housing and the second hip post passes through a side opening in the pelvis housing, and the second disk member having a second disk face;

wherein each face of the contoured friction plate includes a plurality of contour features and the first disk face and the second disk face each abut an opposing face of the contoured friction plate, such that the contoured features are sandwiched between the first disk member and the second disk member and frictional interaction between each disk face and the corresponding contoured friction plate face renders each leg section posable as it is pivoted around an axis defined by the corresponding hip post.

2. The hip joint assembly of claim 1, wherein the contoured friction plate is vertically disposed along the centerline of the pelvis housing.

3. The hip joint assembly of claim 1, wherein the plurality of contour features include a plurality of rib structures.

4. The hip joint assembly of claim 3, wherein the rib structures are substantially parallel to one another.

5. The hip joint assembly of claim 3, wherein the rib structures are substantially horizontally oriented.

6. The hip joint assembly of claim 3, wherein the rib structures are separated by inset regions.

7. The hip joint assembly of claim 1, wherein the face of each of the first disk member and the second disk member is substantially flat.

8. The hip joint assembly of claim 1, further comprising an upper torso section that is coupled to the pelvis section.

9. The hip joint assembly of claim 8, wherein the upper torso section is pivotally coupled to the pelvis section by a waist joint.

10. The hip joint assembly of claim 1, wherein each hip post has a post diameter that is about half the diameter of its associated disk member.

11. A toy figure, comprising:

a pelvis housing, coupled to the upper torso member by an articulated waist joint; and two leg members coupled to the pelvis housing by pivotable hip joint assemblies;

where the pelvis housing includes a front portion and a back portion configured such that in combination the front portion and the back portion define two openings in the pelvis housing, and a contoured friction plate that is vertically disposed within the pelvis housing; and each pivotable hip joint assembly includes a disk member coupled to one of the two leg members via a hip post, where the disk member is disposed within the pelvis housing and the hip post passes through one of the openings in the pelvis housing, and each disk member has a disk face;

wherein each disk face abuts opposing faces of the contoured friction plate, and each of the opposing faces of the contoured friction plate includes a plurality of contour features, such that the contoured features are sandwiched between the first disk member and the second disk member and a frictional interaction between each disk face and the corresponding contoured friction plate face renders each of the two leg members posable as it is pivoted on an axis defined by its hip post.

12. The toy figure of claim 11, further comprising an upper torso member; two arm members coupled to the upper torso member by articulated shoulder joints; and a head member coupled to the upper torso member.

* * * * *